US006481642B1

(12) United States Patent
Louis, Jr. et al.

(10) Patent No.: US 6,481,642 B1
(45) Date of Patent: Nov. 19, 2002

(54) PORTABLE MISTING APPARATUS AND METHOD FOR DELIVERING A MIST

(75) Inventors: Ralph Frank Louis, Jr., 5474 Round Meadow Rd., Hidden Hills, CA (US) 91302; Lester F. Goldtein, Scottsdale, AZ (US)

(73) Assignee: Ralph Frank Louis, Jr., Hidden Hills, CA (US)

( * ) Notice: Subject to any disclaimer, the term of this patent is extended or adjusted under 35 U.S.C. 154(b) by 6 days.

(21) Appl. No.: 09/650,009

(22) Filed: Aug. 28, 2000

(51) Int. Cl.[7] ..... B05B 9/08

(52) U.S. Cl. ..... 239/152; 239/373

(58) Field of Search ..... 239/128, 146, 239/152–154, 302, 311, 289, 337, 372, 373; 222/4, 5, 399, 400.7

(56) References Cited

U.S. PATENT DOCUMENTS

| | | | |
|---|---|---|---|
| 638,207 | A | 11/1899 | Rice |
| 803,661 | A | 11/1905 | Brandt |
| 876,453 | A | 1/1908 | Heard |
| 1,042,627 | A | 10/1912 | Watson |
| 1,382,397 | A | 6/1921 | Whitehouse |
| 1,731,767 | A | 10/1929 | Cramer |
| 2,083,039 | A | 6/1937 | Searls |
| 2,513,455 | A | 7/1950 | Cornelius |
| 2,723,161 | A | 11/1955 | Covington |
| 2,735,589 | A | 2/1956 | Milster et al. |
| 2,744,662 | A | 5/1956 | Smith et al. |
| 2,865,541 | A | 12/1958 | Hicks |
| 2,911,157 | A | 11/1959 | Converse |
| 2,924,359 | A | 2/1960 | Beremand |
| 3,018,970 | A | 1/1962 | Wittenberg et al. |
| 3,107,069 | A | 10/1963 | Draim |
| 3,116,856 | A | 1/1964 | Prussin et al. |
| 3,174,658 | A | 3/1965 | Wittenberg et al. |
| 3,184,113 | A | 5/1965 | Curtis |
| 3,190,562 | A | 6/1965 | Atwwod et al. |
| 3,228,558 | A | 1/1966 | Doyle et al. |
| 3,342,379 | A | 9/1967 | Foley |
| 3,421,697 | A | 1/1969 | Marks |
| 3,450,163 | A | 6/1969 | Mercier et al. |
| 3,469,578 | A | 9/1969 | Bierman |
| 3,524,475 | A | 8/1970 | Kirk, Jr. |
| 3,539,110 | A | 11/1970 | Kobayashi |
| 3,802,511 | A | 4/1974 | Good, Jr. |
| 3,993,245 | A | 11/1976 | Smith |
| 4,043,510 | A | 8/1977 | Morris |
| 4,048,994 | A | 9/1977 | Lo |
| 4,067,485 | A | 1/1978 | Soin |
| 4,120,425 | A | 10/1978 | Bethurum |
| 4,206,877 | A | 6/1980 | Hoza, III |
| 4,328,843 | A | 5/1982 | Fujii |
| 4,407,454 | A | 10/1983 | Massey |
| 4,458,830 | A | 7/1984 | Werding |
| 4,526,298 | A | 7/1985 | Boxer et al. |
| 4,651,903 | A | 3/1987 | Pagliai |
| 4,688,643 | A | 8/1987 | Carter et al. |

(List continued on next page.)

FOREIGN PATENT DOCUMENTS

| | | |
|---|---|---|
| CH | 63752 | 11/1891 |
| CH | 387374 | 5/1965 |
| DE | 1912328 | 5/1970 |
| DE | 3544660 | 6/1987 |
| DK | 41354 | 12/1929 |
| FR | 754269 | 4/1933 |
| FR | 1164746 | 10/1958 |
| IT | 675036 | 11/1964 |

*Primary Examiner*—Lesley D. Morris
(74) *Attorney, Agent, or Firm*—Blakely Sokoloff Taylor & Zafman, LLP

(57) ABSTRACT

A portable misting device is charged with gas from a pressurized source. Fluid is discharged from the device through a nozzle coupled to a flexible tube. The fluid stream emitted from the nozzle may be modified by a fan to create a fine spray mist.

7 Claims, 6 Drawing Sheets

U.S. PATENT DOCUMENTS 4,721,250 A 1/1988 Kennedy et al.
4,807,813 A 2/1989 Coleman
4,836,409 A 6/1989 Lane
4,867,344 A 9/1989 Bitterly
4,875,508 A 10/1989 Burke, II et al.
5,069,363 A 12/1991 Daimler
5,104,016 A 4/1992 Runkel
5,141,462 A 8/1992 Latzel
5,150,814 A 9/1992 Broyhill
5,150,819 A 9/1992 Johnson et al.
5,154,324 A 10/1992 Stratford
5,154,332 A 10/1992 Williams et al.
5,158,212 A 10/1992 Sirhan
5,478,015 A 12/1995 Black
5,979,793 A 11/1999 Louis
6,158,669 A 12/2000 Louis
6,196,474 B1 * 3/2001 Hillerson ..... 239/289

* cited by examiner

PORTABLE MISTING APPARATUS AND METHOD FOR DELIVERING A MIST

FIELD OF THE INVENTION

The invention relates to misting devices. More specifically, the invention relates to portable misting devices.

BACKGROUND OF THE INVENTION

Misting devices have been used for years in connection with different applications. One application of misting devices provides a way of cooling off or refreshing individuals (users) outdoors when hot. Typically, in a misting device, a fluid, such as water, is fed to one or more nozzles that spray the water in a mist in a direction where a user may stand, sit or lay. One problem with these misting devices is that many of these devices are not self-contained. The water is typically fed to the misting device from a reservoir located remotely from the misting device and/or the misting device is not transportable, i.e., is fixed in a given location. A motorized pump discharges the water from the device. The remote reservoir and proximity to a power source (e.g., 120 volt electrical supply) limits the mobility of the misting device, and implicitly of the users who are prevented from freely moving outdoors wherever they desire and still being able to use the misting device. U.S. Pat. Nos. D412,199 and D422,051 issued to the inventor describe designs for misting devices. Such devices work well in applications where the misting device is moved to one location (even a remote location) for use.

Self-contained portable misting devices are another class of misting device that allows a user to transport the device with him or her. These include devices described in U.S. Pat. No. 5,979,793 and U.S. Pat. No. 6,158,669 which, in embodiments, describe battery-operated pumping systems that charge a volume of fluid stored in the device. Many self-contained portable misting devices use hand held pumps to pressurize a fluid chamber (i.e., reservoir) in order to discharge mist. A user must expend energy to pump up the device prior to and/or during use. This effort is contrary to the purpose of the misting device, which is to cool of a person. Therefore, it would be desirable to lower the degree of human effort expended to charge a misting device.

SUMMARY

The invention provides a misting device that comprises a bottle for holding a volume of fluid that is charged with a gas from a pressurized source. In one embodiment, the bottle comprises an interior chamber adapted to hold a fluid, an opening and a sleeve extending from the opening through a portion of the interior chamber. A cap assembly coupled to the opening comprises a gas inlet configured to pressurize the bottle and a fluid outlet configured to discharge fluid. The bottle also comprises an interior tube that extends from the fluid outlet, between the sleeve and through a portion of the interior chamber configured to discharge fluid through the fluid outlet. Fluid is discharged from the bottle through a flexible tube that includes a nozzle at one end and is connected to a fluid outlet on the other end. In another embodiment, the stream of fluid discharged from the nozzle is modified by a fan coupled to the nozzle. A tubing clamp attached to the flexible tube may be used to constrict the tube, so as to control the discharge from the nozzle and the fan.

BRIEF DESCRIPTION OF THE DRAWINGS

The invention is illustrated by way of example and not by way of limitation in the figures of the accompanying drawings, in which the like references indicate similar elements in and in which.

DETAILED DESCRIPTION

In the following description, the invention is described with reference to specific exemplary embodiments thereof. It will, however, be evident that various modifications and changes may be made thereto without departing from the broader spirit and scope of the invention as set forth in the appended claims. The specification and drawings are to be regarded in an illustrative rather than a restrictive sense.

Figure 1:
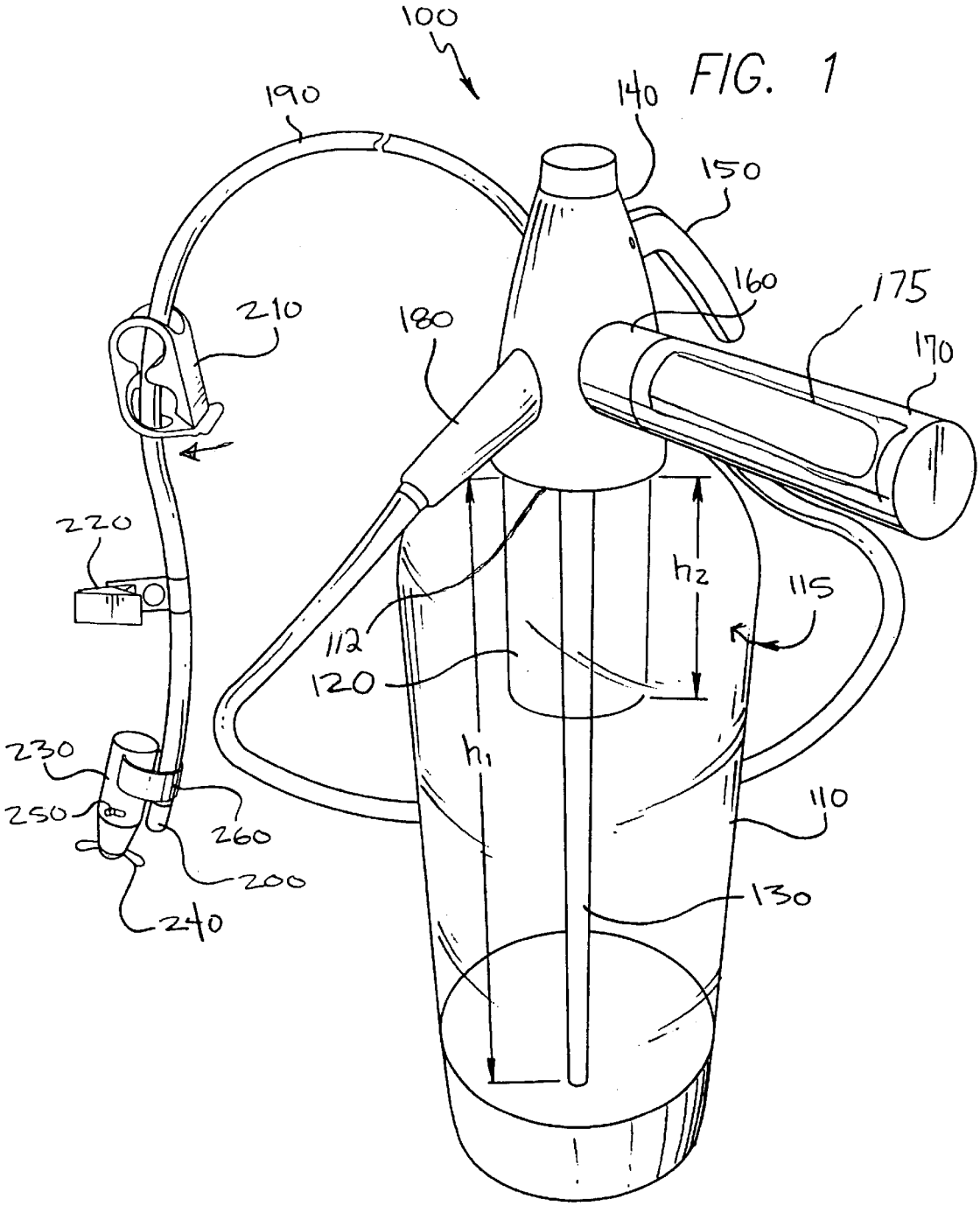
FIG. 1 is a top front and side perspective view of one embodiment of a misting device according to the invention.

FIG. 1 illustrates a front and side perspective view of an embodiment of a misting device according to the invention. Misting device 100 includes bottle 110 which includes opening 112 and interior chamber 115, which defines a volume for holding a fluid. Sleeve 120 is disposed in opening 112 and extends through a portion of interior chamber 115.

Cap assembly 140 is coupled to opening 112 and comprises lever arm 150, gas inlet 160 and fluid outlet 180. Lever arm 150 has open and closed positions and controls flow through an orifice disposed in cap assembly 140 (see FIGS. 3 and 4). Although lever arm 150 is shown in this figure, the use of lever arm 150 is illustrative, it being understood that other structures can be used to control flow through an orifice. Cartridge housing 170 holds gas cartridge 175 and is coupled to gas inlet 160.

Interior tube 130 is disposed between sleeve 120 and extends from fluid outlet 180 through a portion of interior chamber 115. Gas is released from gas cartridge 175 through gas inlet 160 into interior chamber 115, thereby pressurizing interior chamber 115 (e.g., increasing the gas pressure). The pressure in interior chamber 115 causes the fluid in interior chamber 115 to be discharged through interior tube 130. If lever arm 150 is in the open position (see FIG. 4), fluid continues to flow from interior chamber 115 through fluid outlet 180. Fluid outlet 180 is coupled to one end of flexible tube 190. A fluid discharged from interior chamber 115 to fluid outlet 180 is further discharged through nozzle 200 which is coupled to flexible tube 190.

Tubing clamp 210 is coupled to flexible tube 190 and can be tightened in varying degrees so as to constrict flexible tube 190. By constricting flexible tube 190, a user can control the discharge of fluid from nozzle 200.

The fluid stream discharged from nozzle 200 is further modified, in this embodiment, by fan 230, which is coupled to nozzle 200 by latch 260. The fluid stream passes through fan blade 240, which disperses an evenly distributed fine mist over a defined area. In one embodiment, fan 230 is battery-operated and activated by on/off switch 250.

Swivel bulldog clip 220 is coupled to flexible tube 190. Swivel bulldog clip 220 may be coupled to a person's clothes or another object, so as to direct the fluid discharge from nozzle 200 to a desired location.

Figure 2:
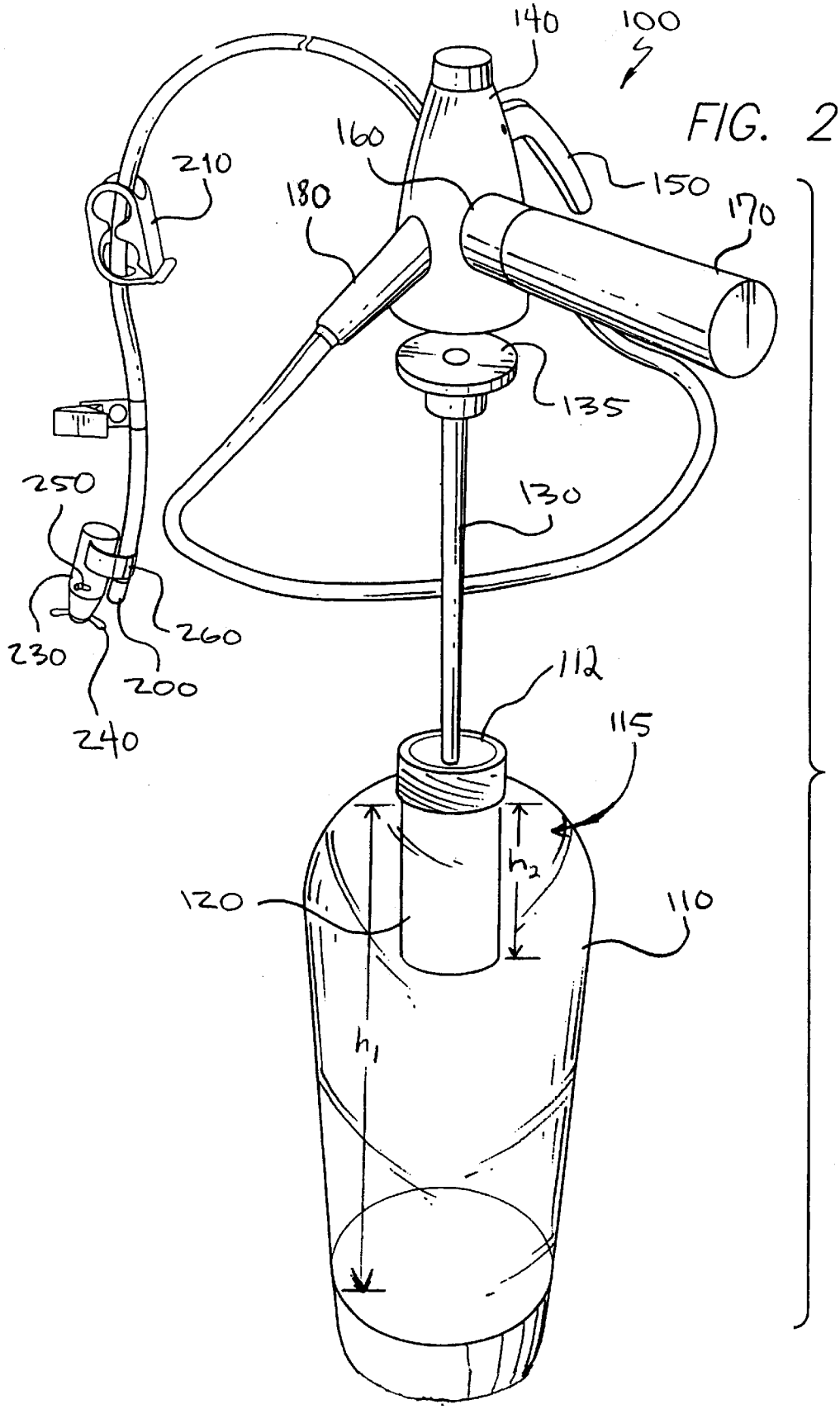
FIG. 2 is an exploded view of the apparatus of FIG. 1.

FIG. 2 is an exploded view of misting device 100. The figure illustrates seal 135 coupled to the end of interior tube 130 that is coupled to fluid outlet 180. In one aspect, seal 135 prevents fluid and gas from flowing into cap assembly 140, except through interior tube 130 and permits interior chamber 115 to be pressurized without gas (e.g., air) escaping through cap assembly 140.

In one embodiment of the invention, interior chamber 115 has a defined height $h_1$ from top to bottom. Sleeve 120 is disposed in opening 112, extends from opening 112 through a portion of interior chamber 115, and has a defined height $h_2$ from top to bottom. As interior chamber 115 is filled with fluid, air in interior chamber 115 is displaced and escapes through opening 112. When interior chamber 115 is filled with fluid up to the bottom end of sleeve 120 (i.e., up to the end of sleeve 120 not disposed in opening 112), air in interior chamber 115 can no longer escape through opening 112, and interior chamber 115 cannot be further filled with fluid because no more air can be displaced in interior chamber 115. As such, the structure, in this embodiment of the invention, prevents interior chamber 115 from being filled with fluid at a height higher than a height defined as $h_1-h_2$.

Figure 3:
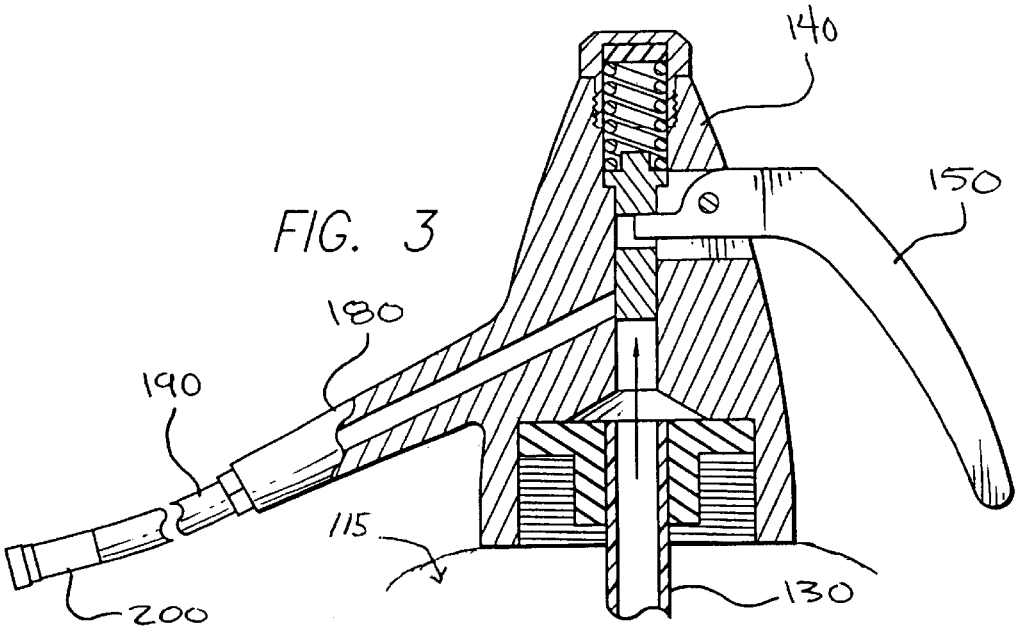
FIG. 3 is a cross-sectional view of the cap assembly of one embodiment of the invention with the lever arm in a closed position.

FIG. 3 is a cross-sectional view of cap assembly 140 according to an embodiment of the invention with lever arm 150 in a closed position. When lever arm 150 is in a closed position, the orifice between interior tube 130 and fluid outlet 180 will be blocked. As such, fluid is prevented from flowing from interior tube 130 to fluid outlet 180, and fluid cannot be discharged from interior chamber 115. Accordingly, when lever arm 150 is in a closed position, no fluid will be emitted from nozzle 200.

Figure 4:
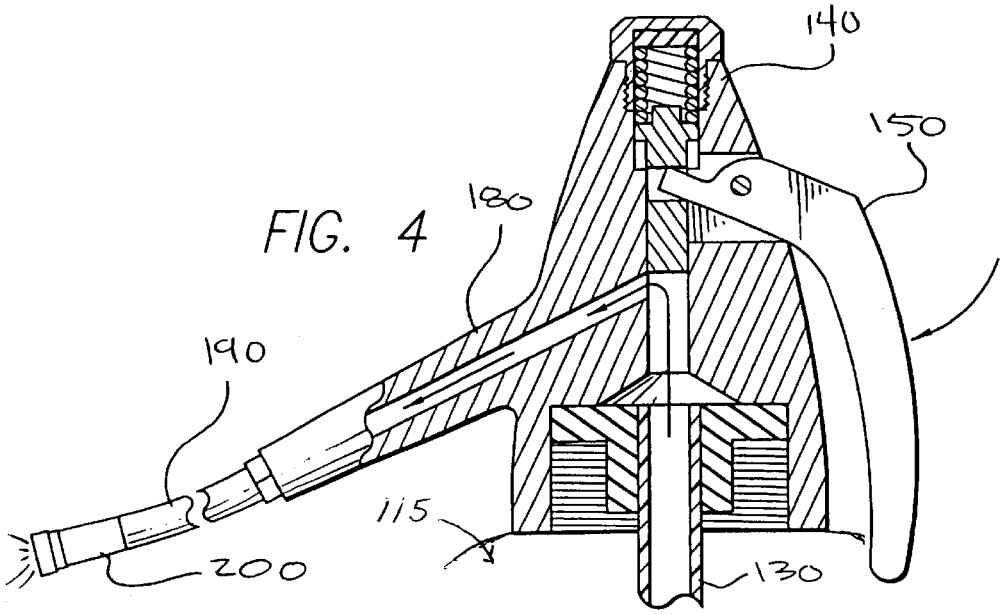
FIG. 4 is a cross-sectional view of the cap assembly of one embodiment of the invention with the lever arm in an open position.

FIG. 4 is a cross-sectional view of cap assembly 140 in an embodiment of the invention with lever arm 150 in an open position. When lever arm 150 is in an open position, the orifice between interior tube 130 and fluid outlet 180 will not be blocked. As such, fluid will flow from interior tube 130 to fluid outlet 180, thereby discharging fluid from interior chamber 115. The fluid will continue to flow from fluid outlet 180, through flexible tube 190, and will be emitted from nozzle 200.

Figure 5:
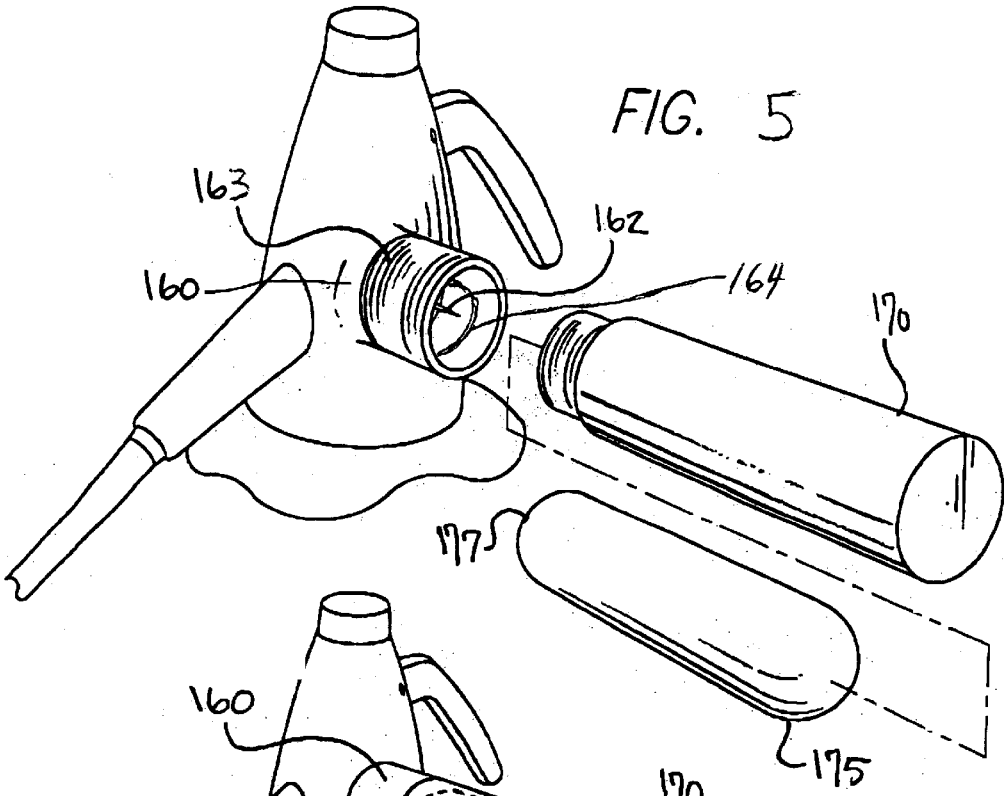
FIG. 5 is an exploded partial cross-sectional view of the gas inlet assembly of one embodiment of the invention.

FIG. 5 is an exploded partial cross-sectional view of gas inlet 160 in an embodiment of the invention. Gas inlet 160 comprises pin 162. Gas inlet 160 also comprises outer threading 163, which is used to threadably couple cartridge housing 170 to gas inlet 160. Cartridge housing 170 holds gas cartridge 175. Gas cartridge 175 comprises puncturable seal 177 and is pressurized with a gas containing carbon dioxide ($CO_2$), or with another suitable gas, including air. In this embodiment, threadably coupling cartridge housing 170 with gas cartridge 175 to gas inlet 160, will puncture seal 177 by pin 162, thereby releasing a pressurized gas into gas inlet 160. Also, in this embodiment, gas inlet 160 includes rubber gasket 164, which envelopes puncturable seal 177 and a portion of gas cartridge 175, so as to create a seal and prevent gas from escaping through cartridge housing 170 when gas is being released from gas cartridge 175 into gas inlet 160.

Figure 6:
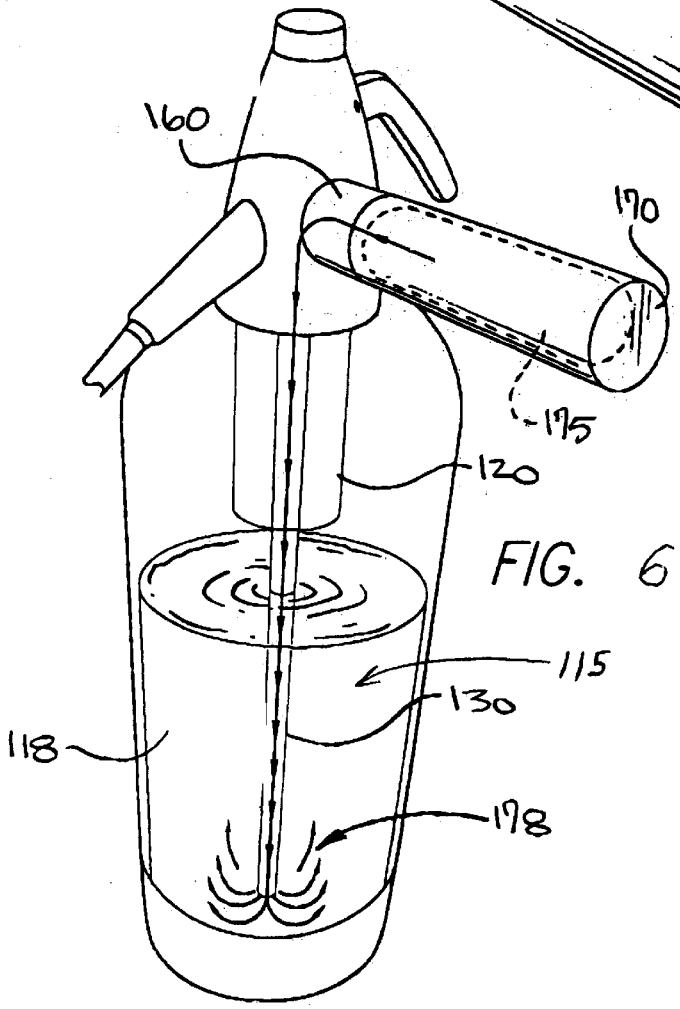
FIG. 6 is a partial cross-sectional view of one embodiment of the invention illustrating fluid inside the interior chamber and gas entering the interior chamber.

FIG. 6 is a partial cross-sectional view of an embodiment of the invention illustrating fluid 118 inside interior chamber 115 and gas 178 entering interior chamber 115. Pressurized gas 178 is released from gas cartridge 175 into gas inlet 160. Gas 178 flows through interior tube 130 and is expelled into interior chamber 115, thereby pressurizing interior chamber 115. It is to be appreciated that other pressurized sources may be substituted for gas cartridge 175, such suitable sources include, but are not limited to, manual or motorized compressors (e.g., bike pump, motorized compressor).

Figure 7:
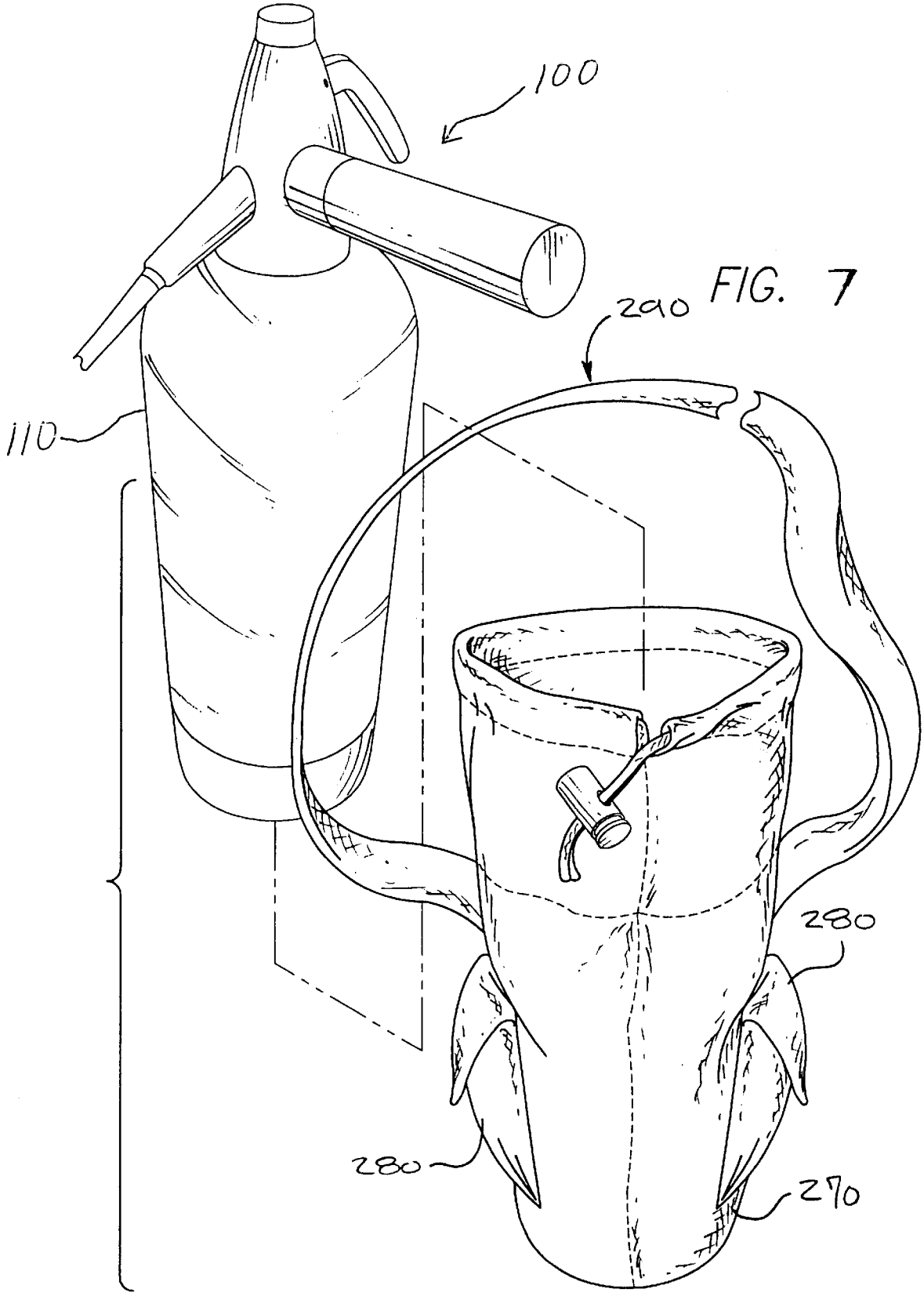
FIG. 7 is a perspective view of one embodiment of the invention including a carrying case.

FIG. 7 is a perspective view of an embodiment of the invention including carrying case 270. A portion of bottle 110 can be inserted into carrying case 270. Carrying case 270 comprises pockets 280 and strap 290. Pockets 280 may be used to store extra carbon dioxide cartridges 175, unused fan 230, or other items.

To illustrate one of many uses of carrying case 270, strap 290 may be attached to a person so that carrying case 270, holding misting device 100, can be worn by the user. As such, the user can wear or carry misting device 100 to any desired location. Also, to illustrate another use of carrying case 270, the user could use strap 290 to attach carrying case 270, holding misting device 100, to any object. It should be appreciated that misting device 100 may be situated close to a user by various means, including, but not limited to, being held by the user, carried or worn by the user, or attached to a nearby object, such as a golf cart or an umbrella.

Figure 8:
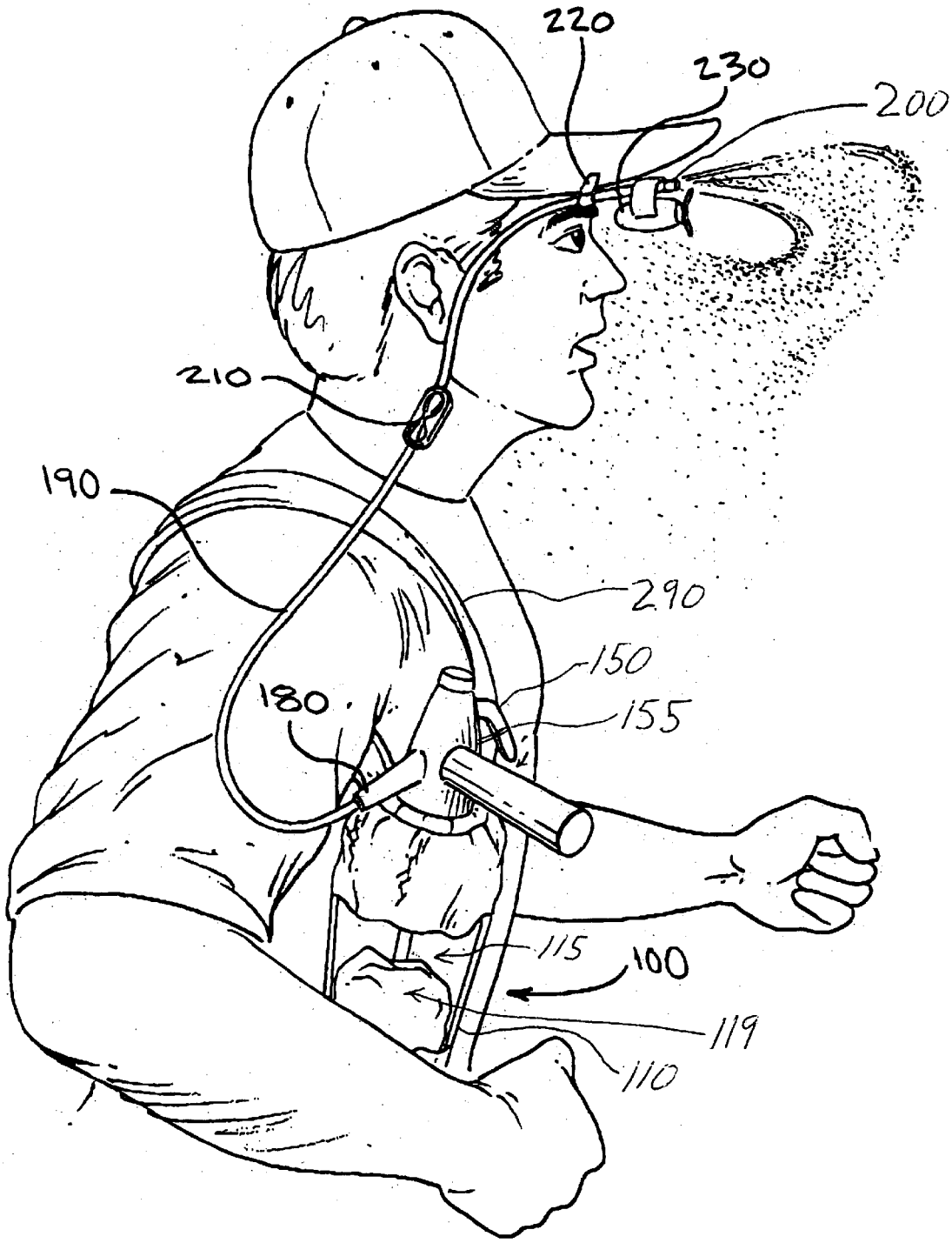
FIG. 8 is a perspective view of a person wearing one embodiment of the invention.

FIG. 8 is a perspective view of a person wearing an embodiment of the invention. This figure includes a partial cross sectional view of interior chamber 115 in an embodiment of the invention illustrating block of ice 119 in interior chamber 115.

To illustrate one preferred use of misting device 100, a portion of bottle 110 is inserted into carrying case 270. A user wears charged misting device 100 by attaching strap 290 around his or her shoulder. Swivel bulldog clip 220 is coupled to flexible tube 190. Swivel bulldog clip 220 is further coupled to the clothing or accessories (such as a hat) of the user, so as to direct the mist discharge from fan 230 to a location desired by the user.

In this embodiment of the invention, strap 155 is coupled to lever arm 150. Strap 155 can be tightened so as to depress lever arm 150 and maintain lever arm 150 in an open position, so that fluid is continuously discharged through nozzle 200. Tubing clamp 210 is coupled to flexible tube 190. Tubing clamp 210 may be squeezed in varying degrees so as to constrict flexible tube 190, thereby restricting flow through flexible tube 190 and controlling the mist discharge from nozzle 200 and fan 230.

The figure also illustrates, in this embodiment, ice 119 in interior chamber 115. A user may fill a first portion of interior chamber 115 with ice 119 (e.g., crushed or blocks) that fits through opening 112 of bottle 110 and add, either before or after, a second fluid volume. Using this method, the fluid discharged from nozzle 200 will be cooler in comparison to when interior chamber 115 is only filled with fluid. In another embodiment, a jacket having a volume to store a liquid may surround the exterior portion bottle 110 either as an integral portion (i.e., jacket and bottle 110 are integrally formed) or as a removable portion. In the case of a jacket containing a volume of liquid such as water, the volume may be frozen prior to use of the device (such as by freezing overnight) and the frozen volume may serve to cool the volume of liquid in interior chamber 115.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. An apparatus, comprising:

a bottle having an interior chamber defining a volume for holding a fluid and an opening;

a sleeve disposed in the opening, extending through a portion of the interior chamber;

a cap assembly coupled to the bottle about the opening, the cap assembly comprising:

a gas inlet for pressurizing the bottle, a fluid outlet, an interior tube extending from the fluid outlet disposed between the sleeve, and extending through a portion of the interior chamber for discharging fluid from the interior chamber, an orifice disposed between the fluid outlet and the interior tube, and a flexible tube, having a first end coupled to the fluid outlet, and a nozzle coupled to a second end of the flexible tube.

2. The apparatus of claim 1 further comprising a second chamber adapted to contain pressurized gas, coupled to the gas inlet such that the pressurized gas is released into the cap assembly.

3. The apparatus of claim 2 wherein the pressurized gas comprises carbon dioxide.

4. The apparatus of claim 1, further comprising: a fan coupled to the flexible tube adjacent the nozzle and adapted to disperse fluid emitted from the nozzle as a mist over a defined area.

5. The apparatus of claim 1, further comprising a swivel bulldog clip coupled to the flexible tube.

6. The apparatus of claim 1, further comprising a tubing clamp coupled to the flexible tube, the tubing clamp adapted to be tightened around the flexible tube in varying degrees so as to constrict the flexible tube.

7. The apparatus of claim 1, further comprising a carrying case having an interior opening adapted to contain a portion of the bottle and a strap coupled to the exterior of the carrying case.

* * * * *

UNITED STATES PATENT AND TRADEMARK OFFICE

CERTIFICATE OF CORRECTION

PATENT NO. : 6,481,642 B2
DATED : November 19, 2002
INVENTOR(S) : Louis, Jr. et al.

It is certified that error appears in the above-identified patent and that said Letters Patent is hereby corrected as shown below:

Title page,
Item [75], Inventors, please delete "Goldtein" and insert -- Goldstein --.

Signed and Sealed this

Twentieth Day of July, 2004

JON W. DUDAS
*Acting Director of the United States Patent and Trademark Office*